US008308157B2

(12) United States Patent
Fujita et al.

(10) Patent No.: US 8,308,157 B2
(45) Date of Patent: Nov. 13, 2012

(54) CONVEYING DEVICE

(75) Inventors: Masahiko Fujita, Osaka (JP); Yasuaki Fukada, Osaka (JP); Kohji Aoki, Osaka (JP); Yoshiyuki Kobayashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/939,245

(22) Filed: Nov. 4, 2010

(65) Prior Publication Data

US 2011/0140350 A1 Jun. 16, 2011

(30) Foreign Application Priority Data

Dec. 11, 2009 (JP) ..... 2009-281571

(51) Int. Cl.
*B65H 5/00* (2006.01)

(52) U.S. Cl. ..... 271/225; 271/303

(58) Field of Classification Search ..... 271/225, 271/303, 304
See application file for complete search history.

(56) References Cited

U.S. PATENT DOCUMENTS

| | | | | |
|---|---|---|---|---|
| 4,750,016 | A * | 6/1988 | Kusumoto et al. | 399/405 |
| 5,118,093 | A * | 6/1992 | Makiura et al. | 271/291 |
| 5,234,213 | A * | 8/1993 | Chen | 271/303 |
| 5,237,381 | A * | 8/1993 | Hamada | 399/406 |
| 5,553,528 | A * | 9/1996 | Zoltner | 83/443 |
| 5,862,435 | A * | 1/1999 | Suzumi et al. | 399/68 |
| 6,332,611 | B1 * | 12/2001 | Tomita | 271/273 |
| 6,511,241 | B2 * | 1/2003 | Fetherolf et al. | 400/664 |
| 7,216,866 | B2 * | 5/2007 | Taniguchi | 271/303 |
| 7,431,294 | B2 * | 10/2008 | Taniguchi | 271/303 |
| 7,862,041 | B2 * | 1/2011 | Taniguchi | 271/303 |
| 7,918,449 | B2 * | 4/2011 | Sugiyama et al. | 271/186 |
| 2002/0098010 | A1 | 7/2002 | Inoue et al. | |
| 2003/0210924 | A1 | 11/2003 | Inoue et al. | |

FOREIGN PATENT DOCUMENTS

| | | | |
|---|---|---|---|
| JP | 05-116800 | A | 5/1993 |
| JP | 06183625 | A * | 7/1994 |
| JP | 10-147451 | A | 6/1998 |
| JP | 11-143156 | A | 5/1999 |
| JP | 2002-220134 | A | 8/2002 |
| JP | 2009-120277 | A | 6/2009 |

* cited by examiner

*Primary Examiner* — Kaitlin Joerger
(74) *Attorney, Agent, or Firm* — Renner, Otto, Boisselle & Sklar, LLP

(57) ABSTRACT

A conveying device includes a switching gate, a handle, and a link mechanism. The switching gate switches the direction in which a sheet of paper is conveyed along a conveying path. Normally, the weight of the switching gate keeps a front end portion of the gate engaging with a recess. A user grips the handle when he/she opens the conveying device from an apparatus. The user's grip on the handle makes the link mechanism disengage the gate portion from the recess. The link mechanism includes a protrusion protruding toward the apparatus and having a slope, which tapers off. When the conveying device closes into the apparatus, compressive contact of the protrusion slope with a wall of the apparatus disengages the gate portion from the recess.

2 Claims, 12 Drawing Sheets

CONVEYING DEVICE

CROSS REFERENCE

This Nonprovisional application claims priority under 35 U.S.C. §119(a) on Patent Application No. 2009-281571 filed in Japan on Dec. 11, 2009, the entire contents of which are hereby incorporated by reference.

BACKGROUND OF THE INVENTION

The present invention relates to a conveying device that can turn on a vertical axis at the rear of an apparatus.

A conveying device that can be turned from an apparatus may be the conveying device fitted near the delivery unit in an image forming apparatus. When the image forming apparatus is jammed with a sheet of paper near the delivery unit of the apparatus, a user removes the sheet by turning the conveying device from the main body of the apparatus. A sheet of paper with which the image forming apparatus is jammed may be nipped in both a roller pair of the main body and a roller pair of the conveying device. In this case, if the conveying device is turned from the main body, the sheet may be torn and remain in the main body and the conveying device, so that the sheet may be difficult to remove.

JP-H11-143156-A discloses an image forming apparatus including a conveying device and a structure for preventing a sheet of paper with which the apparatus is jammed from being torn. When a user turns the conveying device from the main body of the image forming apparatus, this structure disengages the rollers of a roller pair of the main body from each other so as to prevent the sheet from being torn.

The conveying device fitted to an image forming apparatus that can switch back a sheet of paper includes a switching gate for guiding the sheet to a proper conveying path. The image forming apparatus includes a paper guide. Normally, the weight of the switching gate keeps a front end portion of the gate engaging with the recess formed in the paper guide. With the gate portion engaging with the recess, a sheet of paper conveyed from the fixing unit of the image forming apparatus passes over the paper guide by raising the gate portion out of engagement with the recess. When the sheet switches back, the weight of the switching gate keeps the gate portion engaging with the recess so that the sheet can be conveyed to the switchback path without being conveyed back to the fixing unit.

If the conveying device were turned from the main body of the image forming apparatus, with the gate portion engaging with the recess in the paper guide, the gate portion might break.

A solenoid might be provided for disengaging the gate portion from the recess in the paper guide. When the conveying device is turned from the main body of the image forming apparatus, the solenoid could disengage the gate portion from the recess, preventing the portion from breaking. However, the extra provision of the solenoid would increase costs and need additional space, which would enlarge the main body.

In view of the foregoing problems, the object of the present invention is to provide a conveying device including a switching gate a front end portion of which can be disengaged from the recess in the paper guide of an image forming apparatus by the action of the handle of the conveying device.

SUMMARY OF THE INVENTION

A conveying device according to the present invention can turn on a vertical axis at the rear of an apparatus including a paper guide for holding on a conveying path in the apparatus a sheet of paper being conveyed along the path. The paper guide has recesses spaced perpendicularly to the conveying direction in which the sheet is conveyed along the conveying path. The conveying device includes a switching gate, a handle, and a link mechanism.

The switching gate switches the conveying direction. Normally, the weight of the switching gate keeps a front end portion of the gate engaging with the recess in the paper guide. A user grips the handle when he/she opens the conveying device from the apparatus. The user's grip on the handle makes the link mechanism disengage the gate portion from the recess. The link mechanism includes a protrusion protruding toward the apparatus. The protrusion has a slope tapering off. When the conveying device closes into the apparatus, compressive contact of the slope with a wall of the apparatus disengages the gate portion from the recess.

When the user opens the conveying device from the apparatus, his/her grip on the handle raises the front end portion of the switching gate out of engagement with the recess in the paper guide. This prevents the paper guide and the switching gate from interfering with each other when the conveying device opens from the apparatus.

When the conveying device closes into the apparatus, the compressive contact of the tapering slope of the protrusion of the link mechanism with the apparatus wall raises the front end portion of the switching gate out of engagement with the recess in the paper guide. This prevents the paper guide and the switching gate from interfering with each other when the conveying device closes into the apparatus.

DETAILED DESCRIPTION OF THE INVENTION

Conveying devices embodying the present invention will be described in detail below with reference to the drawings.

Figure 1:
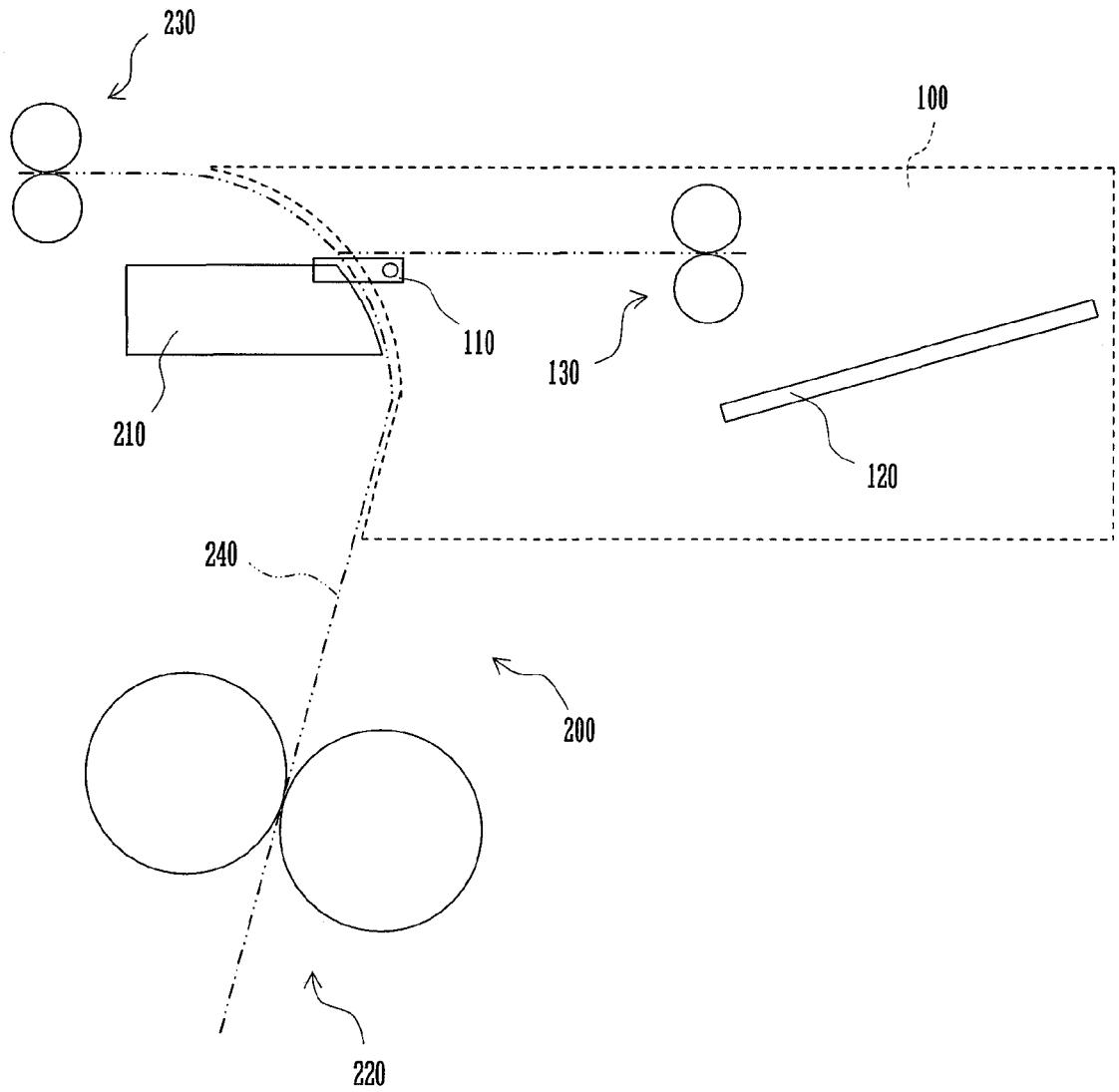
FIG. 1 is a schematic diagram showing a conveying device according to a first embodiment of the present invention and parts near the device.

FIG. 1 shows a conveying device 100 according to a first embodiment of the present invention and parts near the device.

The conveying device 100 is fitted to an image forming apparatus 200 and includes a switching gate 110, a delivery tray 120, and a pair of delivery rollers 130. The delivery tray 120 and delivery rollers 130 correspond to the delivery unit of the present invention. The image forming apparatus 200 includes a paper guide 210, a fixing unit 220, a pair of reversing rollers 230, and a conveying path 240.

Figure 2:
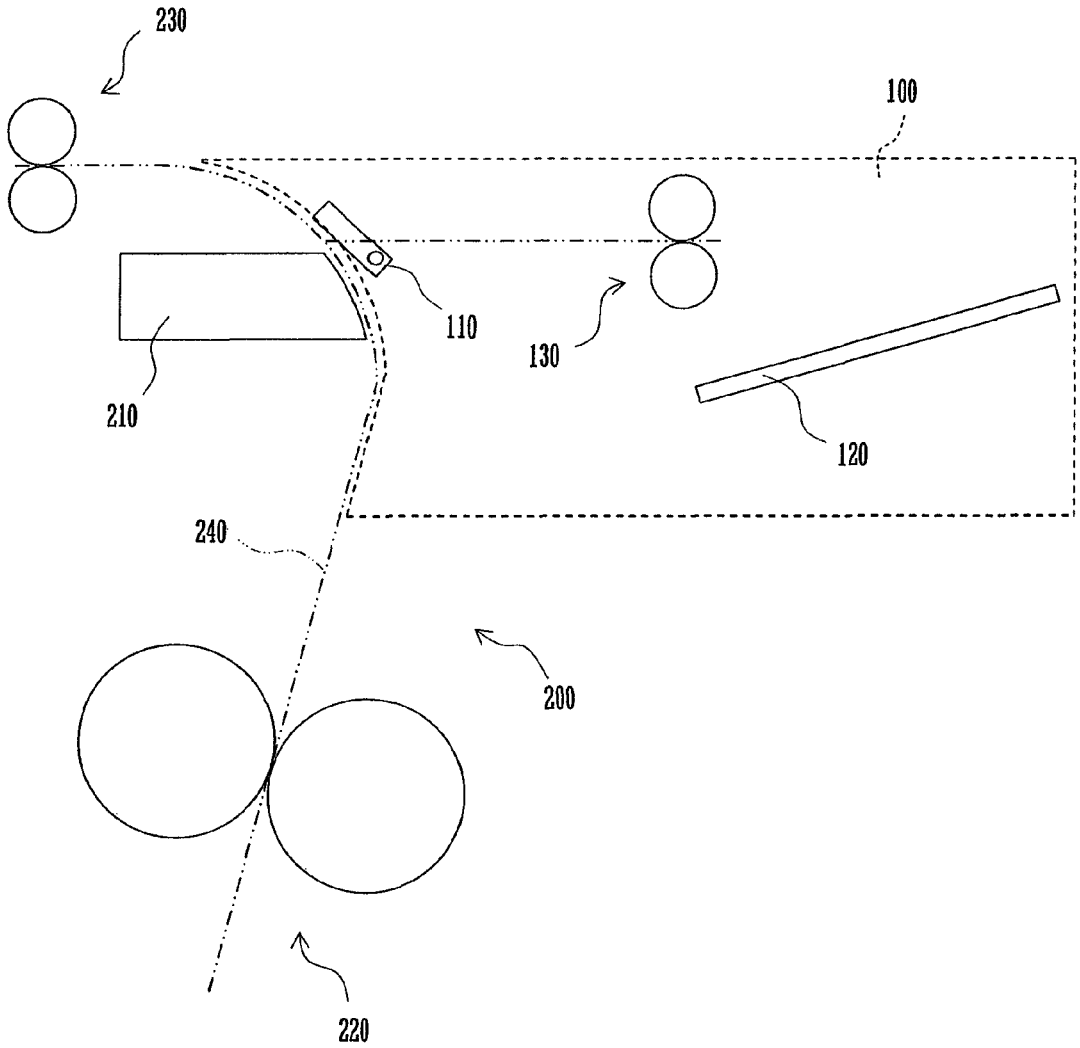
FIG. 2 is another schematic diagram showing the conveying device and the parts near the device.

The switching gate 110 switches the conveying direction in which a sheet of paper is conveyed along the conveying path 240. When the switching gate 110 is not pressed by a sheet of paper having passed through the fixing unit 220, a front end portion of the gate 110 is in engagement with the paper guide 210, as shown in FIG. 1. When the switching gate 110 is pressed by the sheet, the front end portion of the gate 110 is out of engagement with the paper guide 210, as shown in FIG. 2.

The delivery tray 120 holds the sheets delivered by the delivery rollers 130. The paper guide 210 holds on the conveying path 240 a sheet of paper being conveyed along the path between the fixing unit 220 and delivery rollers 130. The fixing unit 220 fixes on a sheet of paper the toner transferred to the sheet in the image forming unit that is upstream along the conveying path 240. The reversing rollers 230 once nip the sheet having passed through the fixing unit 220 and then rotate reversely to convey the sheet to the delivery tray 120. While the reversing rollers 230 are rotating reversely, the switching gate 110 is in engagement with the paper guide 210, preventing the sheet from being conveyed back to the fixing unit 220.

Figure 3:
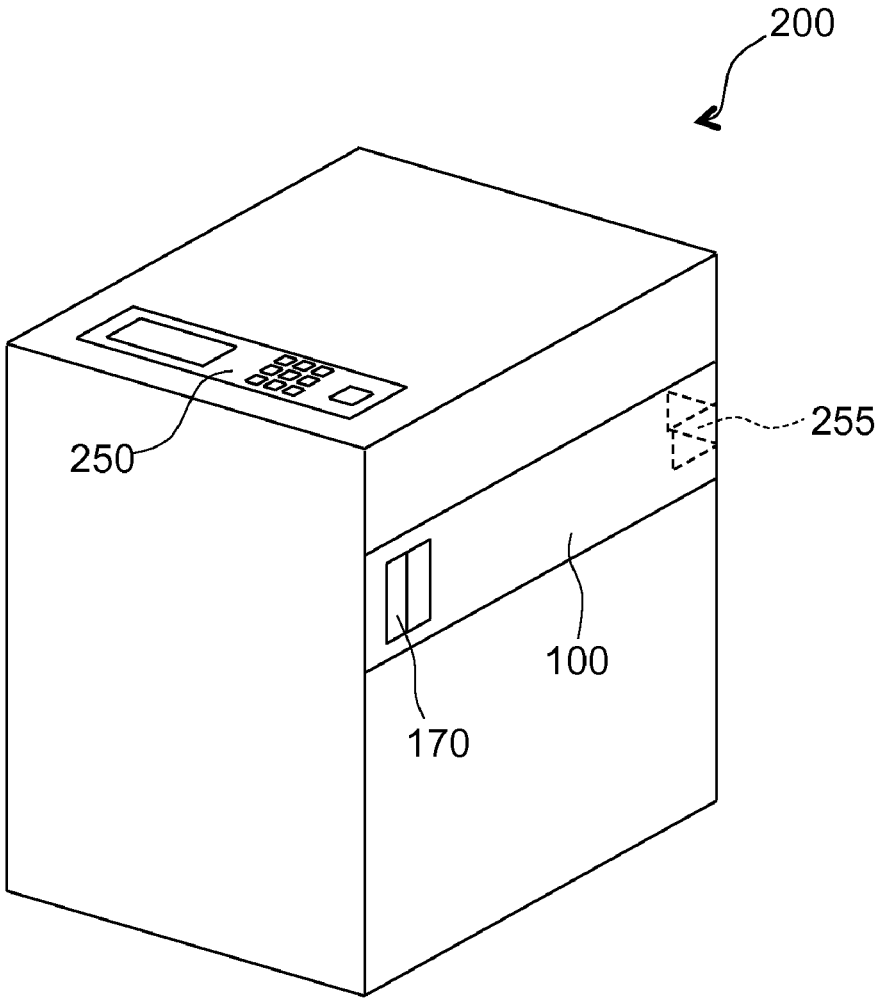
FIG. 3 is a drawing showing the position of the conveying device in an image forming apparatus.

FIG. 3 shows the position of the conveying device 100 in the image forming apparatus 200. For convenience of explanation, the delivery tray 120 is not shown in FIG. 3.

The image forming apparatus 200 is fitted with an operation panel 250. On the assumption that the operation panel 250 is positioned near the front of the image forming apparatus 200, the conveying device 100 is positioned on the right side of the apparatus 200. The conveying device 100 has a handle 170, which a user grips when he/she opens the device 100 from the image forming apparatus 200. The conveying device 100 is connected to the image forming apparatus 200 by a hinge 255, which is positioned at the rear of the apparatus 200. The hinge 255 enables the conveying device 100 to pivot on a vertical axis at the rear of the image forming apparatus 200.

Figure 4:
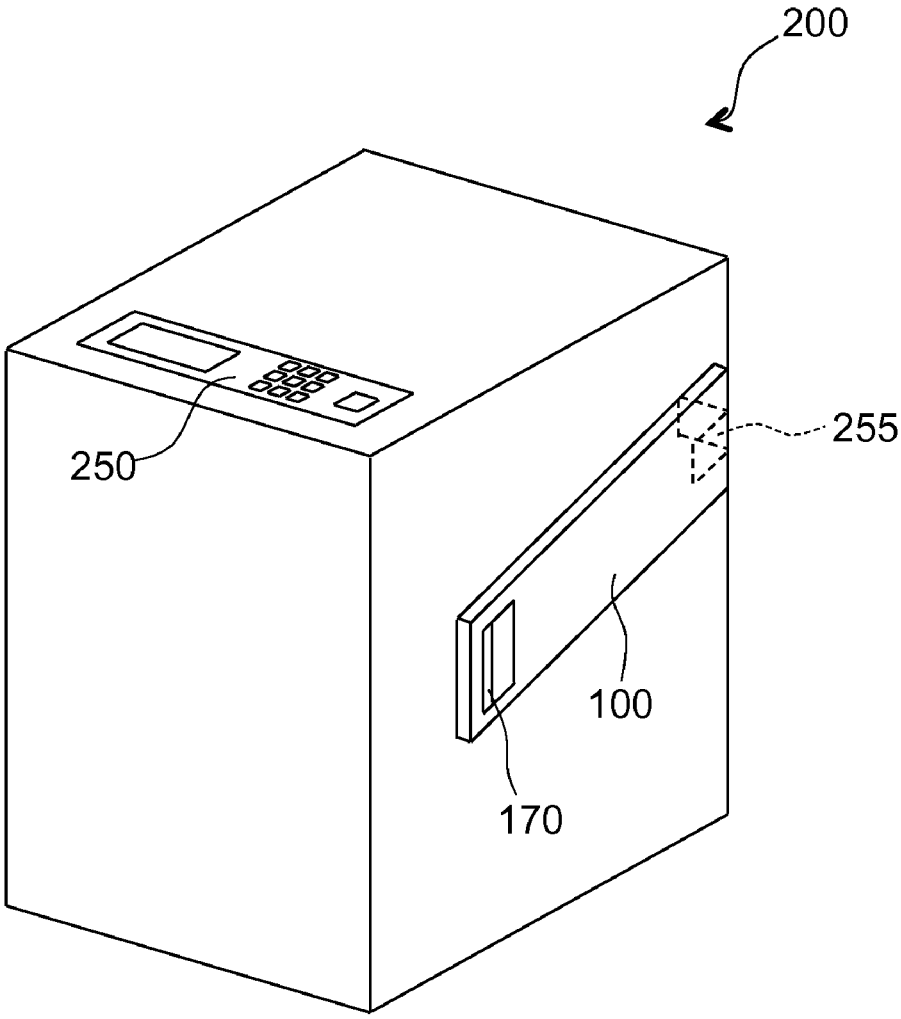
FIG. 4 is a drawing showing the conveying device as opened from the image forming apparatus.

FIG. 4 shows the conveying device 100 as opened from the image forming apparatus 200. For convenience of explanation, the delivery tray 120 is not shown in FIG. 4 either. As shown in FIG. 4, the user can open the conveying device 100 from the image forming apparatus 200 by gripping the handle 170 when the device 100 is closed as shown in FIG. 3.

Figure 5:
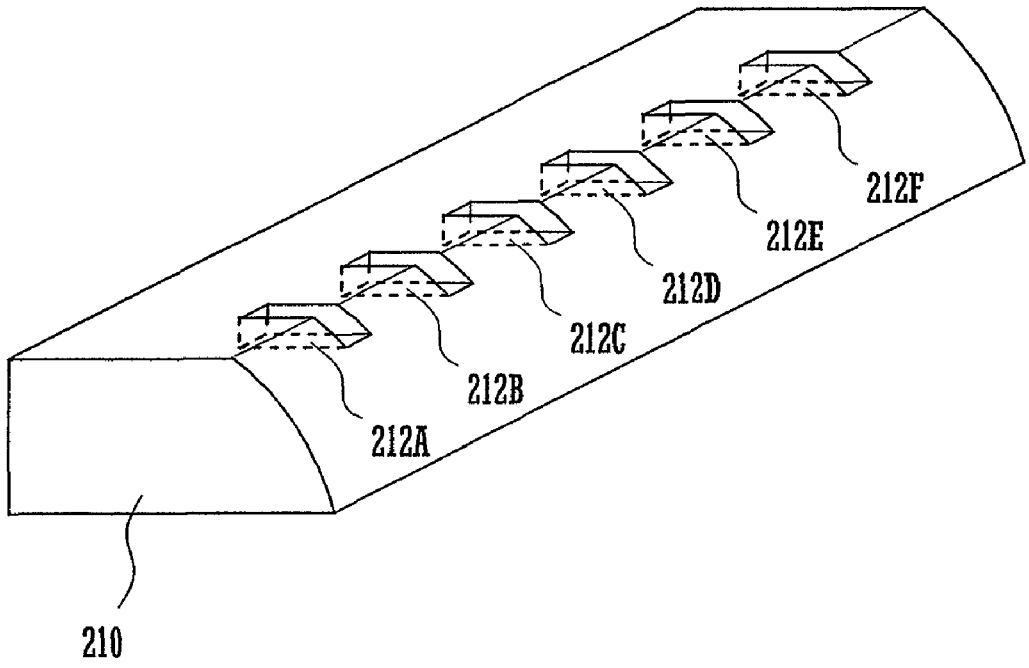
FIG. 5 is a drawing showing the structure of the paper guide of the image forming apparatus.

FIG. 5 is a perspective view of the paper guide 210, which has recesses 212A-212F spaced perpendicularly to the conveying direction. The size of the recesses 212A-212F is such that they can engage with the front end portion of the switching gate 110.

Figure 6:
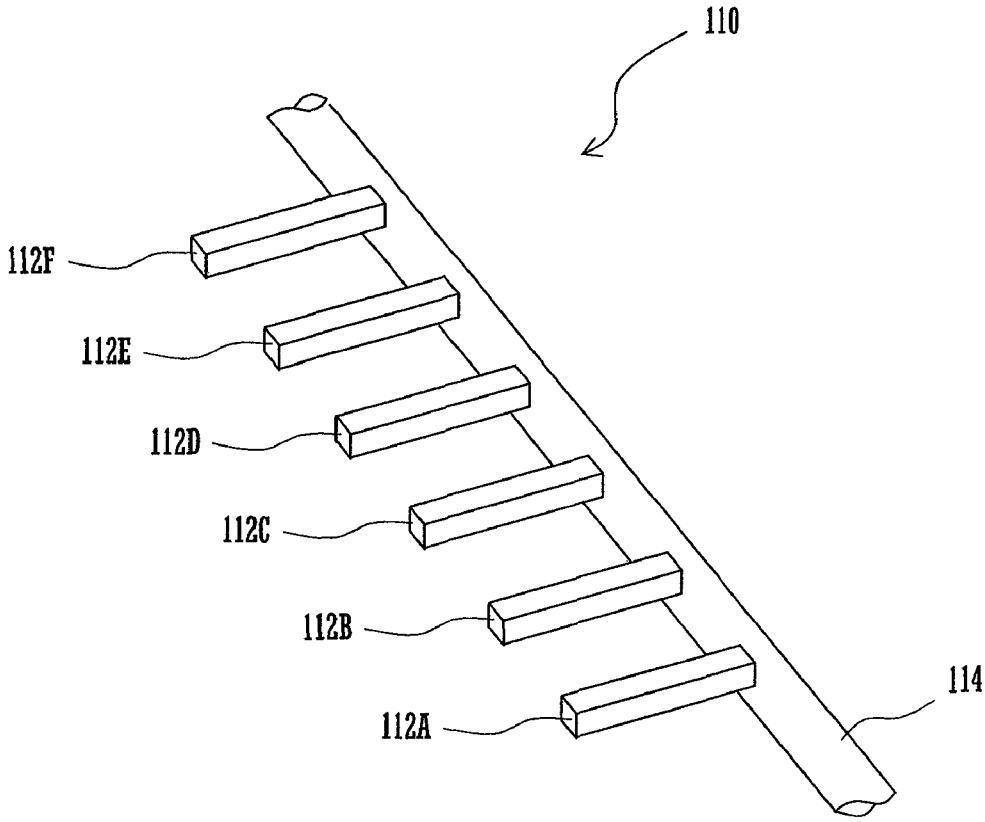
FIG. 6 is a drawing showing the structure of the switching gate of the conveying device.

FIG. 6 is a perspective view of the switching gate 110, which consists of gate members 112A-112F and a switching shaft 114. The switching shaft 114 is supported rotatably by the conveying device 100. The gate members 112A-112F protrude from the switching shaft 114 perpendicularly to the axis of the shaft.

Figure 7:
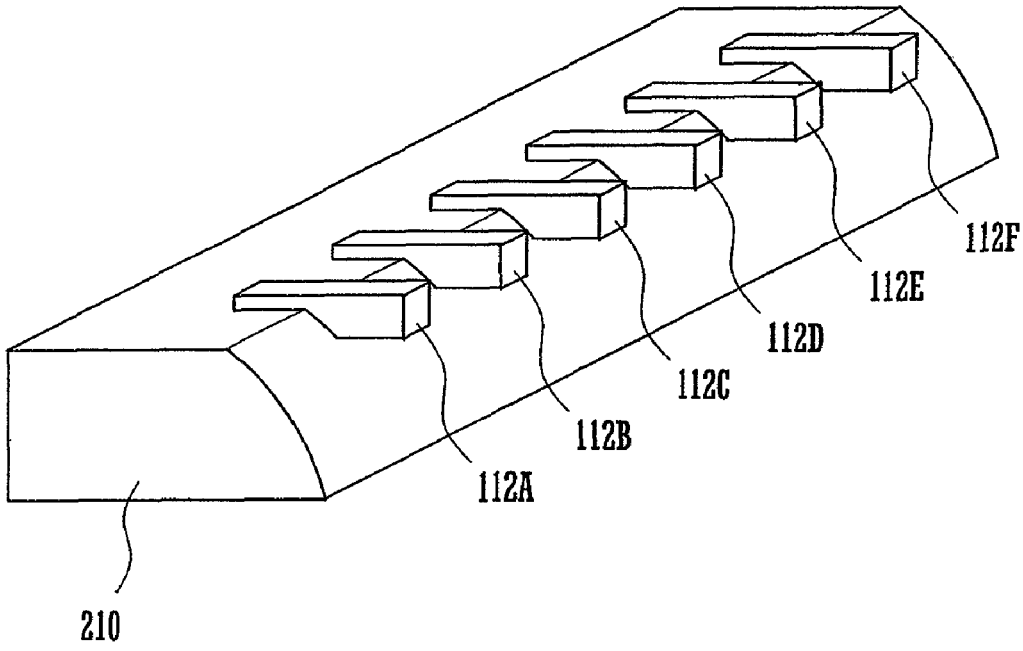
FIG. 7 is a drawing showing the switching gate engaging with the paper guide.

FIG. 7 shows the gate members 112A-112F engaging with the recesses 212A-212F of the paper guide 210. For convenience of explanation, the switching shaft 114 is not shown in FIG. 7. Normally, as shown in FIG. 7, the weight of the gate members 112A-112F keeps them engaging with the recesses 212A-212F. The switching gate 110 is made of light resin or the like, so that a sheet of paper having passed through the fixing unit 220 and being conveyed along the conveying path 240 easily pushes up the gate members 112A-112F out of engagement with the recesses 212A-212F.

Figure 8:
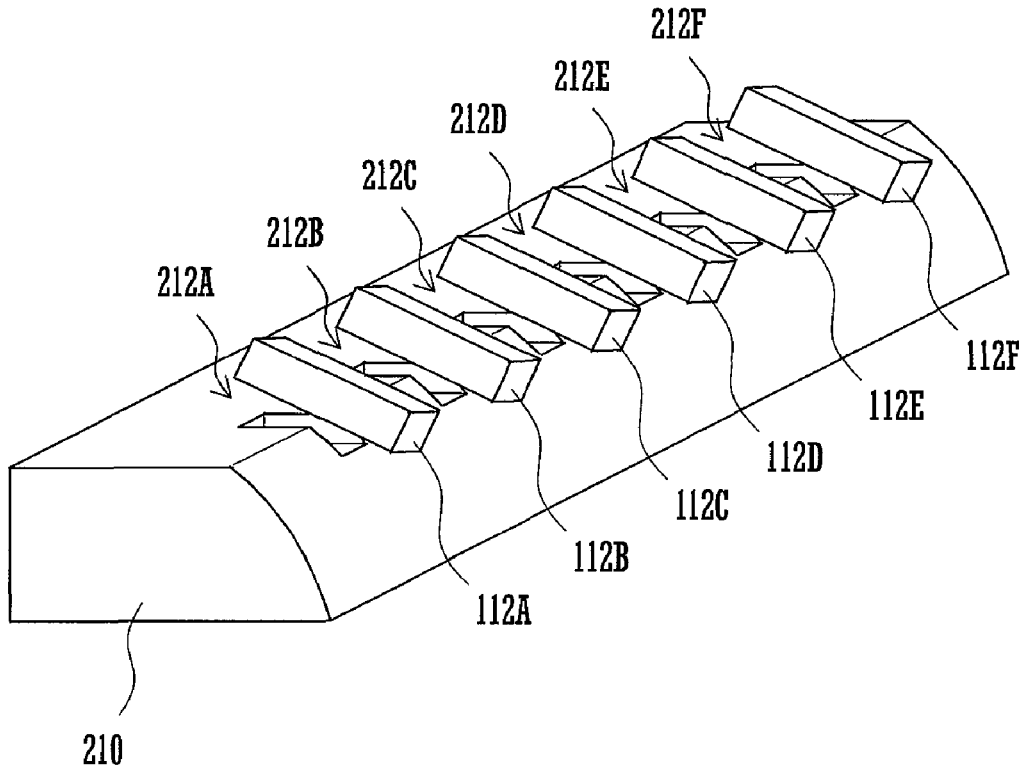
FIG. 8 is a drawing showing the switching gate as disengaged from the paper guide.

FIG. 8 shows the gate members 112A-112F as disengaged from the recesses 212A-212F of the paper guide 210. For convenience of explanation, the switching shaft 114 is not shown in FIG. 8 either. With the gate members 112A-112F out of engagement with the recesses 212A-212F, as shown in FIG. 8, the sheet having passed through the fixing unit 220 and being conveyed along the conveying path 240 can pass through the space between the paper guide 210 and switching gate 110. The user's grip on the handle 170 of the conveying device 100 too disengages the gate members 112A-112F from the recesses 212A-212F.

Figure 9:
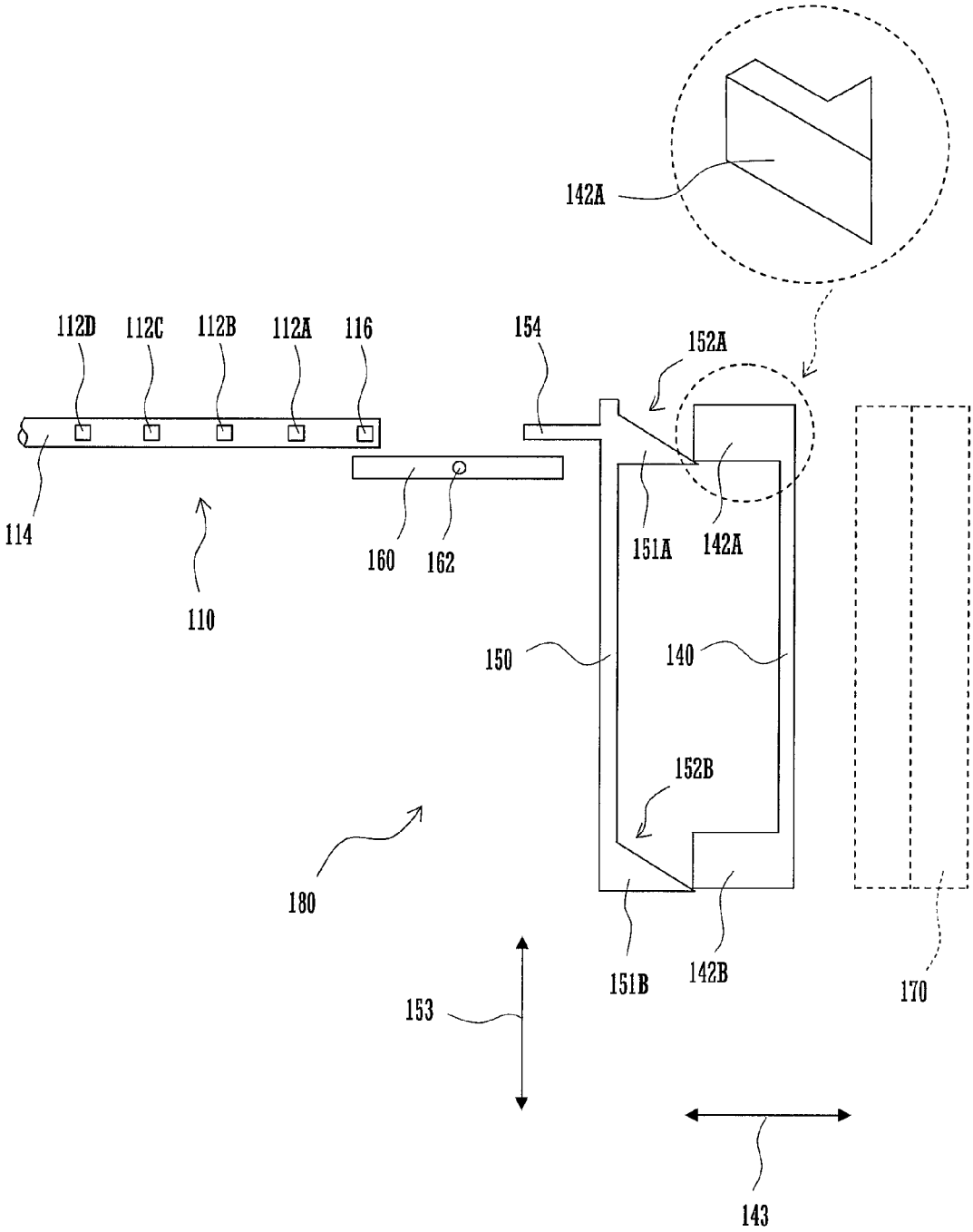
FIG. 9 is a drawing showing a link mechanism for actuating the switching gate.
Figure 10:
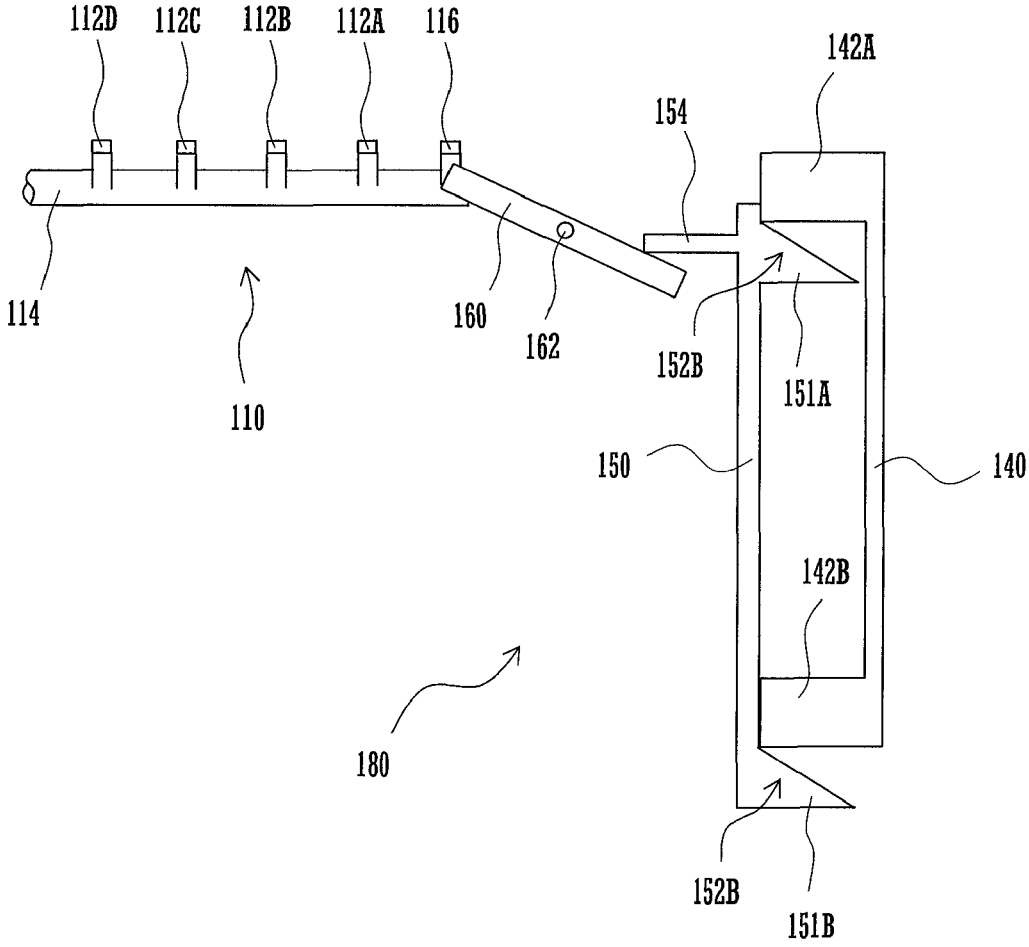
FIG. 10 is another drawing showing the link mechanism.

FIGS. 9 and 10 show a mechanism for turning the switching gate 110 when the handle 170 is gripped. The conveying device 100 includes a link mechanism 180, which the user's grip on the handle 170 causes to disengage the gate members 112A-112F from the recesses 212A-212F. The link mechanism 180 includes a first link 140, a second link 150, a third link 160, and a fourth link 116.

The first link 140 is connected to the handle 170 and can move only in horizontal directions 143. The first link 140 includes a pair of protrusions 142A and 142B for cooperating with the second link 150. For reference, a perspective view of the link protrusion 142A is shown in FIG. 9. The link protrusions 142A and 142B are similar in shape.

The second link 150 can move only in the vertical directions 153. The second link 150 includes a pair of protrusions 151A and 151B for cooperating with the first link 140. The link protrusions 151A and 151B have slopes 152A and 152B respectively. The second link 150 includes another protrusion 154 for cooperating with the third link 160.

The third link 160 takes the form of a bar that can cooperate with the second link 150 and fourth link 116. The middle of the third link 160 is supported rotatably on a horizontal axis 162.

The fourth link 116 is fitted on the end of the switching shaft 114 that is adjacent to the third link 160. The fourth link 116 protrudes from the switching shaft 114 in the same direction as the gate members 112A-112F so as to be able to cooperate with the third link 160.

If the handle 170 is gripped, the first link 140 moves leftward from its position in FIG. 9 to its position in FIG. 10. The leftward movement of the first link 140 brings the protrusions 142A and 142B of this link into compressive contact with the slopes 152A and 152B of the protrusions 151A and 151B of the second link 150, forcing the second link 150 down. The downward movement of the second link 150 makes the protrusion 154 of this link press down the adjacent end of the third link 160, turning the third link 160 on the horizontal axis 162, so that the other end of this link moves upward. Then, the other end of the third link 160 presses up the fourth link 116, turning the switching shaft 114, so that the gate members 112A-112F move out of engagement with the recesses 212A-212F of the paper guide 210.

As stated above, the gate members 112A-112F can be disengaged from the recesses 212A-212F of the paper guide 210 by the link mechanism 180 interlocking with the handle 170 for opening the conveying device 100. Accordingly, the opening of the conveying device 100 from the image forming apparatus 200 does not make the paper guide 210 and switching gate 110 interfere with each other.

Because there is no need to provide a solenoid for disengaging the gate members 112A-112F from the recesses 212A-212F of the paper guide 210, costs can be reduced. Because there is no need for space for such a solenoid, the image forming apparatus 200 avoids being large in size.

FIGS. 11A-11D show different positions that the link protrusion 142A takes relative to a wall 260 of the image forming apparatus 200 when the conveying device 100 closes. Although the link protrusion 142A is shown as an example in FIGS. 11A-11D, the other protrusion 142B of the first link 140 acts likewise. The link protrusions 142A and 142B correspond to the first protrusion of the present invention.

Figure 11A:
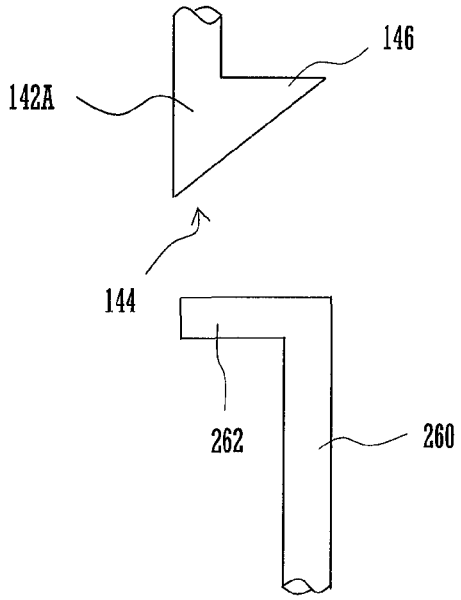
FIGS. 11A-11D are drawings showing different positions that a part of the conveying device takes relative to a wall of the image forming apparatus when the conveying device closes.
Figure 11B:
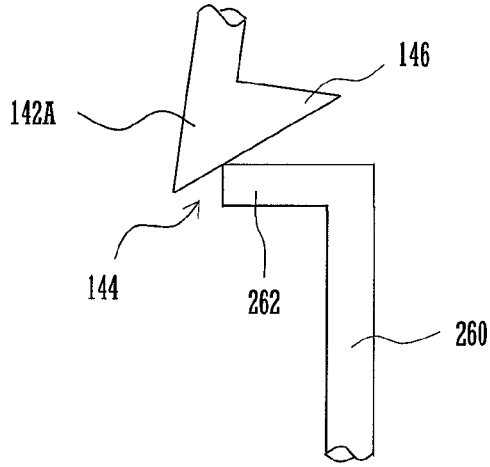

As shown in FIG. 11A, the link protrusion 142A protrudes toward the image forming apparatus 200 and has a slope 144 tapering off. When the conveying device 100 closes, as shown in FIG. 11B, the link protrusion 142A is pushed against the apparatus wall 260, so that the wall 260 and tapering slope 144 cooperate to slide the protrusion 142A on the wall in the closing direction.

While the link protrusion 142A is sliding on the apparatus wall 260 in the closing direction, the first link 140 moves leftward, as shown in FIG. 10, as is the case when the handle 170 is gripped. The operation of the four links 140, 150, 160 and 116 enables the link protrusion 142A to disengage the gate members 112A-112F from the recesses 212A-212F by coming into compressive contact with the apparatus wall 260 when the conveying device 100 closes.

When the conveying device 100 closes into the image forming apparatus 200, the compressive contact of the tapering slope 144 of the link protrusion 142A with the apparatus wall 260 can disengage the gate members 112A-112F from the recesses 212A-212F of the paper guide 210. Accordingly, the closure of the conveying device 100 does not make the paper guide 210 and switching gate 110 interfere with each other.

Because there is no need to provide a solenoid for disengaging the gate members 112A-112F from the recesses 212A-212F of the paper guide 210, costs can be reduced. Because there is no need for space for such a solenoid, the image forming apparatus 200 avoids being large in size.

Figure 11C:
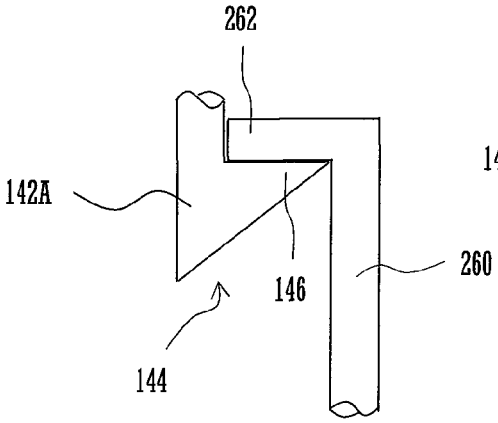

FIG. 11C shows the position that the link protrusion 142A takes relative to the apparatus wall 260 when the conveying device 100 is completely closed. The link protrusion 142A includes an engaging part 146 for engaging with the apparatus wall 260, which includes an engaging part 262 for engaging with the engaging part 146. When the conveying device 100 is completely closed, the engaging parts 146 and 262 engage with each other, preventing the conveying device 100 from being opened accidentally. The user can open the conveying device 100 by gripping the handle 170.

Figure 11D:
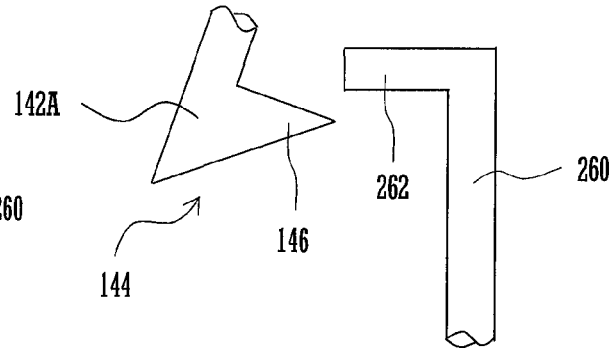

FIG. 11D shows the position that the link protrusion 142A takes relative to the apparatus wall 260 when the user grips the handle 170. When the user grips the handle 170, the engaging parts 146 and 262 disengage from each other, so that the conveying device 100 can open.

FIGS. 12A-12D show the protrusion 142A of the first link 140 of a conveying device 100 according to a second embodiment of the present invention and a wall 270 of an image forming apparatus 200.

In the second embodiment, the link protrusion 142A and apparatus wall 270 differ in shape from the counterparts in the first embodiment. The apparatus wall 270 includes a protrusion 274 having a slope 272 tapering off. The wall protrusion 274 corresponds to the second protrusion of the present invention. The link protrusion 142A includes an engaging part 148 for engaging with the wall protrusion 274.

Figure 12A:
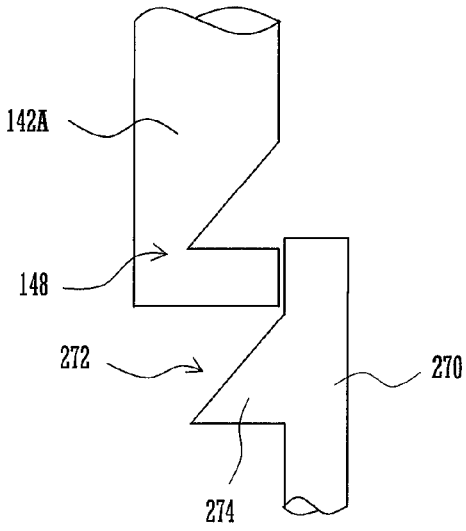
FIGS. 12A-12D are drawings showing different positions that a part of a conveying device according to a second embodiment of the present invention takes relative to a wall of an image forming apparatus when this conveying device closes.
Figure 12B:
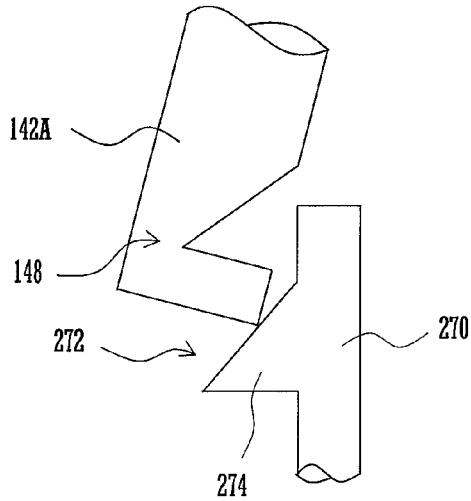

FIG. 12A shows the position that the link protrusion 142A takes relative to the apparatus wall 270 when the conveying device 100 closes. As shown in FIG. 12B, further closure of the conveying device 100 pushes the link protrusion 142A against the wall protrusion 274, so that the link protrusion 142A and the tapering slope 272 of the wall protrusion 274 cooperate to slide the link protrusion 142A on the slope in the closing direction.

While the link protrusion 142A is sliding on the tapering slope 272 of the wall protrusion 274 in the closing direction, the first link 140 moves leftward, as shown in FIG. 10, as is the case when the handle 170 is gripped. The operation of the four links 140, 150, 160 and 116 enables the link protrusion 142A to disengage the gate members 112A-112F from the recesses 212A-212F by coming into compressive contact with the wall protrusion 274 when the conveying device 100 closes.

When the conveying device 100 closes into the image forming apparatus 200, the compressive contact of the link protrusion 142A with the tapering slope 272 of the wall protrusion 274 can disengage the gate members 112A-112F from the recesses 212A-212F of the paper guide 210. Accordingly, the closure of the conveying device 100 does not make the paper guide 210 and switching gate 110 interfere with each other.

Because there is no need to provide a solenoid for disengaging the gate members 112A-112F from the recesses 212A-212F of the paper guide 210, costs can be reduced. Because there is no need for space for such a solenoid, the image forming apparatus 200 avoids being large in size.

Figure 12C:
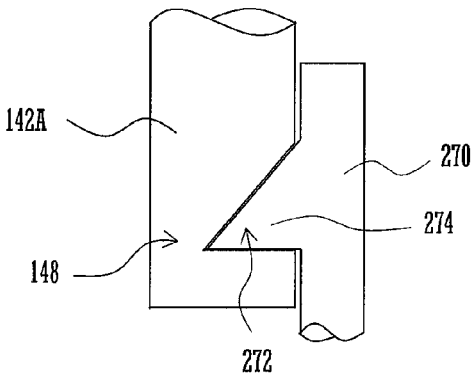

FIG. 12C shows the position that the link protrusion 142A takes relative to the apparatus wall 270 when the conveying device 100 is completely closed. When the conveying device 100 is completely closed, the wall protrusion 274 and the engaging part 148 of the link protrusion 142A engage with each other, preventing the conveying device 100 from being opened accidentally. A user can open the conveying device 100 by gripping the handle 170.

Figure 12D:
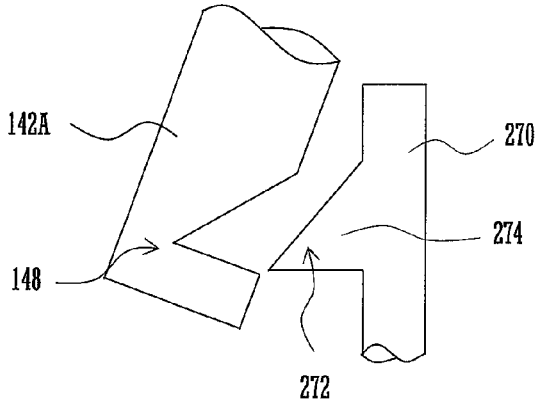

FIG. 12D shows the position that the link protrusion 142A takes relative to the apparatus wall 270 when the user grips the handle 170. When the user grips the handle 170, the wall protrusion 274 and the engaging part 148 of the link protrusion 142A disengage from each other, so that the conveying device 100 can open.

In each of the two embodiments, the paper guide 210 holds on the conveying path 240 a sheet of paper being conveyed along the path between the fixing unit 220 and delivery rollers 130. However, the present invention is not limited to the embodiments. The paper guide might be adapted to hold on another conveying path a sheet of paper being conveyed along the path. In this case, the gate members of the switching gate could engage with the recesses in the paper guide.

The present invention being thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A conveying device turnable on a vertical axis at the rear of an apparatus including a paper guide for holding on a conveying path in the apparatus a sheet of paper being conveyed along the path, the guide having a plurality of recesses spaced perpendicularly to the conveying direction in which the sheet is conveyed along the path, the device comprising:

a switching gate for switching the conveying direction, the gate including a front end portion normally kept engaging with the recess in the paper guide by the weight of the gate;

a handle for being gripped by a user when the user opens the conveying device from the apparatus; and a link mechanism for disengaging the front end portion of the switching gate from the recess in the paper guide in conjunction with the user gripping the handle, wherein the link mechanism includes a first protrusion protruding toward the apparatus while tapering off to its tip so that the first protrusion has a slope extending from the tip, disengages the front end portion of the switching gate from the recess in the paper guide, and the slope being in contact with a wall of the apparatus when the conveying device closes into the apparatus.

2. A conveying device turnable on a vertical axis at the rear of an apparatus including a paper guide for holding on a conveying path in the apparatus a sheet of paper being conveyed along the path, the guide having a plurality of recesses spaced perpendicularly to the conveying direction in which the sheet is conveyed along the path, the device comprising:

a switching gate for switching the conveying direction, the gate including a front end portion normally kept engaging with the recess in the paper guide by the weight of the gate;

a handle for being gripped by a user when the user opens the conveying device from the apparatus; and a link mechanism for disengaging the front end portion of the switching gate from the recess in the paper guide in conjunction with the user gripping the handle, wherein the link mechanism includes a first protrusion protruding toward the apparatus, and the apparatus includes a wall having a second protrusion while tapering off to its tip so that the second protrusion has a slope extending from the tip; and wherein the link mechanism disengages the front end portion of the switching gate from the recess in the paper guide and the first protrusion of the link mechanism being in contact with the slope of the second protrusion of the apparatus wall when the conveying device closes into the apparatus.

* * * * *